US011656045B2

(12) United States Patent
Chen

(10) Patent No.: US 11,656,045 B2
(45) Date of Patent: May 23, 2023

(54) AMMUNITION LOADING AND STORAGE ASSEMBLY

(71) Applicant: Xiaojie Chen, Puning (CN)

(72) Inventor: Xiaojie Chen, Puning (CN)

( * ) Notice: Subject to any disclaimer, the term of this patent is extended or adjusted under 35 U.S.C. 154(b) by 0 days.

(21) Appl. No.: 17/647,455

(22) Filed: Jan. 8, 2022

(65) Prior Publication Data

US 2023/0093656 A1 Mar. 23, 2023

(30) Foreign Application Priority Data

Sep. 17, 2021 (CN) ..... 202122260347.8

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83
See application file for complete search history.

(56) References Cited

U.S. PATENT DOCUMENTS 3,757,449 A * 9/1973 Schindler ..... F41A 9/83 42/87

* cited by examiner

*Primary Examiner* — J. Woodrow Eldred
(74) *Attorney, Agent, or Firm* — Jeenam Park

(57) ABSTRACT

An ammunition loading and storage assembly includes a housing and an upper cover rotatably arranged on the housing. The housing includes a plurality of discrete elongated cavities distributed in the housing along a center axis of the housing, a plurality of discrete grooves distributed on an outer surface of the housing. The upper cover includes a main body with a protruding buckle, a guide tube extending from the main body. The guide tube deviates from each of the plurality of elongated cavities for blocking the elongated cavity to prevent leakage of ammunition under the condition of the protruding buckle received in one of the plurality of discrete grooves. A straight channel is formed by the guide tube cooperatively with one of the plurality of elongated cavities under the condition of the protruding buckle detached from one of the plurality of discrete grooves.

16 Claims, 7 Drawing Sheets

AMMUNITION LOADING AND STORAGE ASSEMBLY

CROSS-REFERENCE TO RELATED APPLICATIONS

The present application claims priority to Chinese Patent Application No. 202122260347.8, filed on Sep. 17, 2021, the content of which is incorporated herein by reference in its entirety.

TECHNICAL FIELD

The present disclosure relates to an ammunition device, and more particularly to an ammunition loading and storage assembly for placing scattered bullets.

BACKGROUND

An ammunition box is a container designed for safe transport and loading of ammunition. Known ammunition boxes are typically made of steel plates and labelled with caliber, quantity, and manufacturing date or lot number. A rubber gasket is commonly found in the hinged lid to protect the ammunition from moisture damage. The resealing ammunition box is largely a NATO tradition.

For simplicity, "ammunition" as used herein shall be considered as a lightweight bullet and gunpowder for hand-held weapons such as pistols, rifles, and shotguns and the like. For ammunition, there are strict guidelines on how ammunition is to be handled, and there are various requirements for ammunition boxes, since they have to be capable of withstanding hostile environments, and must be placed safely to protect the ammunition from falling and exploding. Usually after the shooting exercise training is over, there will be some scattered ammunition or shells. Most armed departments do not have dedicated scattered ammunition collection box. It is usually collected by soldiers or individuals performing tasks with cloth bags, marching bags or other non-professional boxes, and then stored in non-professional collection devices such as old ammunition boxes and wooden boxes. This traditional method of collecting scattered ammunition has disadvantages in terms of convenient carrying, counting of numbers, and safe custody. In addition, due to the large ammunition requirement of rifle, the prior loading device cannot rapidly and large-capacity loading the rifle at one time, and the operation is very inconvenient, and even ammunition is missed, which causes inconvenience to the rifle user.

Therefore, it is necessary to provide a professional scattered ammunition collection box for solving the issues.

SUMMARY

In view of this, the present disclosure is designed to provide an ammunition loading and storage assembly that can store or download bullets or gunpowder conveniently.

An ammunition loading and storage assembly includes a housing in the shape of a cylinder and an upper cover rotatably arranged at one end of the housing. The housing includes a plurality of discrete elongated cavities distributed in the housing along a center axis of the housing, a plurality of discrete grooves distributed on an outer surface of the housing along the direction of the center axis of the housing. The upper cover includes a main body with a protruding buckle, a guide tube extending from the main body along a direction far away from the housing. a straight channel is formed by the guide tube cooperatively with one of the plurality of elongated cavities, on condition that the protruding buckle is received in one of the plurality of discrete grooves. The guide tube deviates from each of the plurality of elongated cavities so that the elongated cavity is covered and blocked by the main body of the upper cover, on condition that the upper cover is rotated and the protruding buckle is accommodated in another groove adjacent to the one of the plurality of discrete grooves.

BRIEF DESCRIPTION OF DRAWINGS

Many aspects of the embodiments can be better understood with reference to the following drawings. The components in the drawings are not necessarily drawn to scale, the emphasis instead being placed upon clearly illustrating the principles of the embodiment.

DETAILED DESCRIPTION OF ILLUSTRATIVE EMBODIMENTS

Embodiments of the present disclosure will be described in detail in conjunction with the drawings. It should be noted that the figures are illustrative rather than limiting. The figures are not drawn to scale, do not illustrate every aspect of the described embodiments, and do not limit the scope of the present disclosure.

It should be noted that when a component is considered to be "connected" to another component, it can be directly connected to another component or a central component can be present between two components at the same time. When a component is considered to be "provided" another component, it may be arranged directly on another component or possibly with a centered component.

Unless otherwise defined, all technical and scientific terms used herein have the same meaning, which is used in the description of the present disclosure to describe specific embodiments and is not intended to limit the disclosure. The term "or/and" used here includes any and all combinations of one or more of the associated listed items.

The present disclosure provides an ammunition loading and storage assembly for storing light bullets or gunpowder. It may conveniently count the number of bullets, and is also convenient to carry and quickly load ammunition for gun.

Referring to FIGS. 1 to 10, an ammunition loading and storage assembly 100 according to an embodiment of the present disclosure is shown. The ammunition loading and storage assembly 100 includes a housing 10 in the shape of a cylinder for loading bullet or gunpowder, an upper cover 30 rotatably arranged at one end of the housing and a lower cover 20 mounted on the other end of the housing 10. The upper cover 30 is arranged in an opening direction of the housing. It is optional that the upper cover 30 may be made of metal, plastic or translucent plastic. The lower cover 20 is used to seal the bottom of the housing. The lower cover 20 is detachably mounted on the housing 10.

Figure 1:
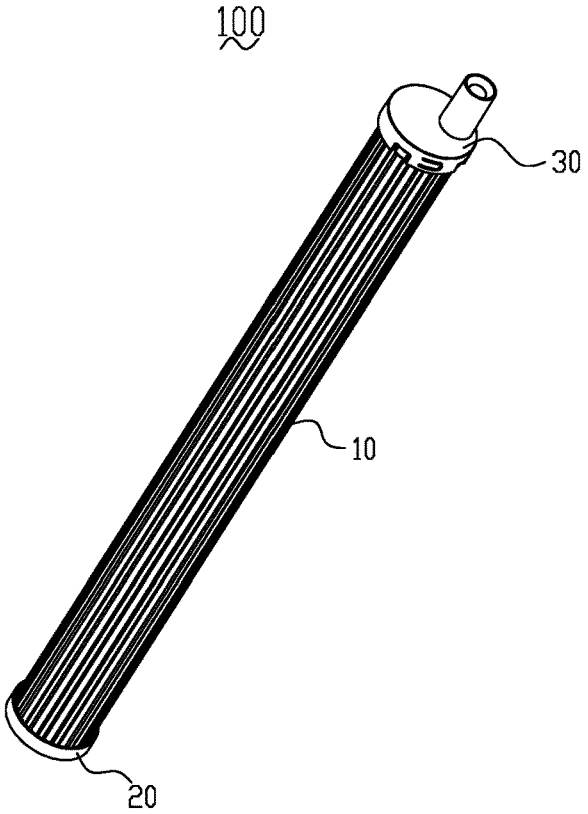
FIG. 1 is an isometric view of an ammunition loading and storage assembly in accordance with a first embodiment of the present disclosure.
Figure 2:
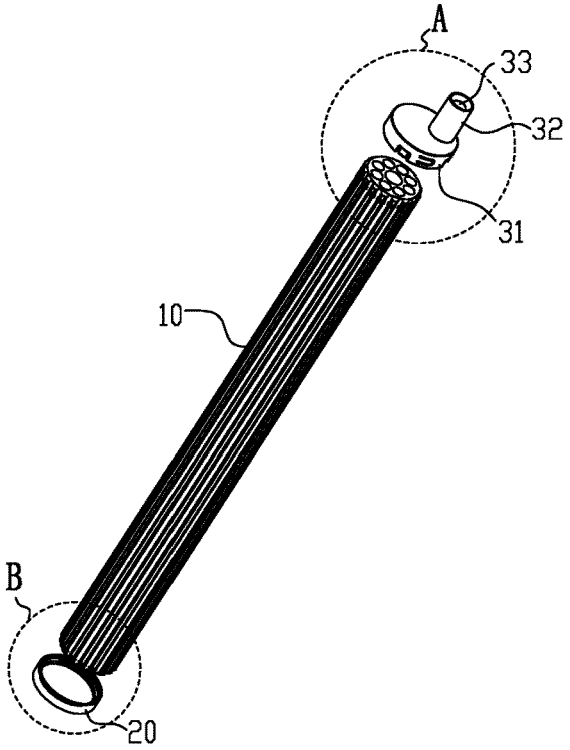
FIG. 2 is an isometric exploded view of the ammunition loading and storage assembly in FIG. 1.
Figure 3:
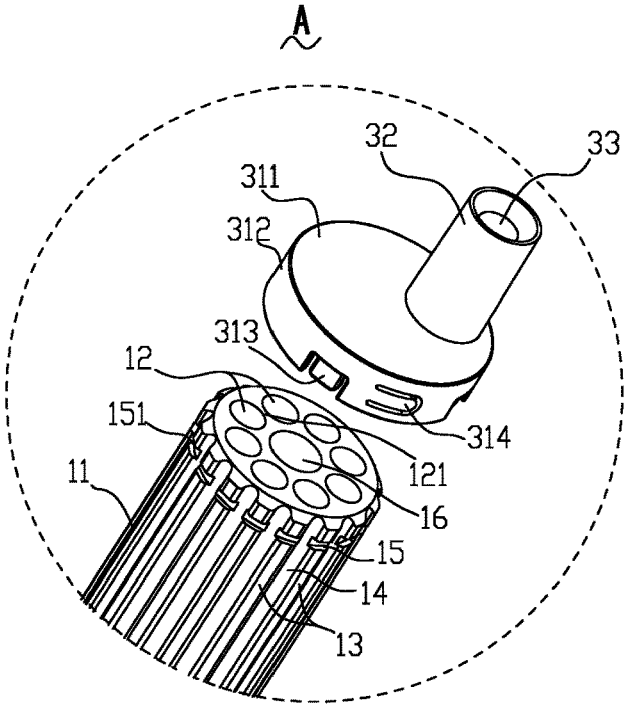
FIG. 3 is an enlarged view of part A in FIG. 2.
Figure 4:
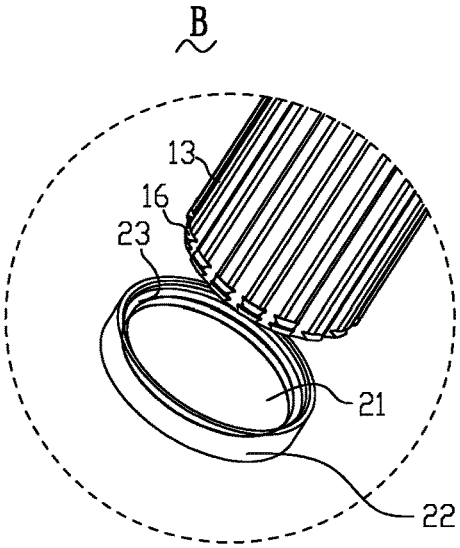
FIG. 4 is an enlarged view of part B in FIG. 2.

In the embodiment, the housing 10 includes a cylindrical body 11 having a center axis, a plurality of discrete elongated cavities 12 distributed in the housing 10 along the center axis and a plurality of discrete grooves 14 distributed on an outer surface of the cylindrical body 11 along the center axis. FIG. 3 illustrates eight elongated cavities 12, but, the amount of the elongated cavity is not limited to eight, and may be adjusted to six, nine or others according to actual requirements. General, the plurality of discrete elongated cavities 12 pierce the cylindrical body 11 so as to form a plurality of openings from a top end into a bottom end of the housing 10, respectively. The plurality of discrete elongated cavities 12 are surrounding around a positioning hole 16 arranged in the central area of the housing 10. The lower cover 20 is mounted on the bottom end of the cylindrical body 11 for sealing the openings on the bottom end. The opening at the top end of cylindrical body 11 is used for loading or outputting ammunition, and ammunition is loaded into the plurality of discrete elongated cavities 12 from the opening at the bottom of the cylindrical body 11. The plurality of discrete elongated cavities 12 are uniformly distributed in the shape of a ring. In other words, a distance between two adjacent elongated cavities is equidistant. A dividing wall 121 is between two adjacent elongated cavities 12. A top view of each of the plurality of discrete elongated cavities 12 is circular. Since the diameter of the circle of the elongated cavity 12 matches a diameter of a bullet, a plurality of bullets may be aligned in a row in one of the elongated cavities 12. It can be understood that an axial length of the housing is at least greater than that of one bullet, and the diameter of each discrete elongated cavity 12 is greater than that of the bullet. Therefore, bullets may be loaded into each discrete elongated cavity 12 from the bottom of the housing 10, and the lower cover 20 is mounted on the housing 10 for sealing.

In additional, the housing 10 may be made of metal, wood or transparent plastic or translucent plastic. Since the size of the ammunition is standard, as long as the depth of the elongated cavity is known, the maximum number of ammunition that may be loaded in the elongated cavity can be known.

In the embodiment, since the plurality of discrete grooves 14 distributed on the outer surface of the housing 10 along the center axis, two ridges 13 are provided on both sides of each of the plurality of discrete grooves 14, respectively. It can be understood that the grooves 14 and the ridges 13 are alternately arranged each other on the surface of the cylinder. The number of ridges 13 is the same as the number of grooves 14. A curved transition surface 131 is provided between the ridge 13 and the groove 14 for connecting to each other.

In additional, a clamping slot 15 is provided on each of the plurality of ridges 12. Therefore, a plurality of clamping slots 15 on the surface of the cylindrical body 11. The clamping slots 15 on each ridge 13 together form an intermittent annular groove 151 for matching and connecting the upper cover 30. It can be understood that the intermittent annular slot 151 is provided on a region close to the top end of the cylindrical body 11 that can be covered by the upper cover 30.

Figure 5:
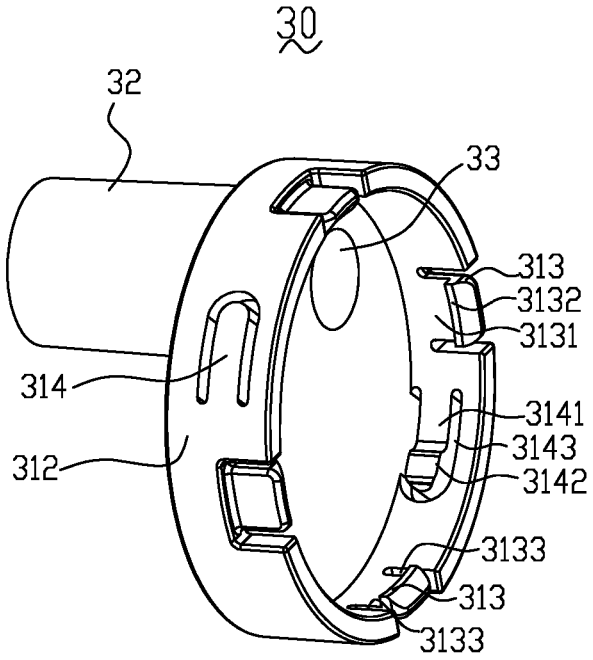
FIG. 5 is an isometric view of an upper cover of the ammunition loading and storage assembly in FIG. 1.
Figure 6:
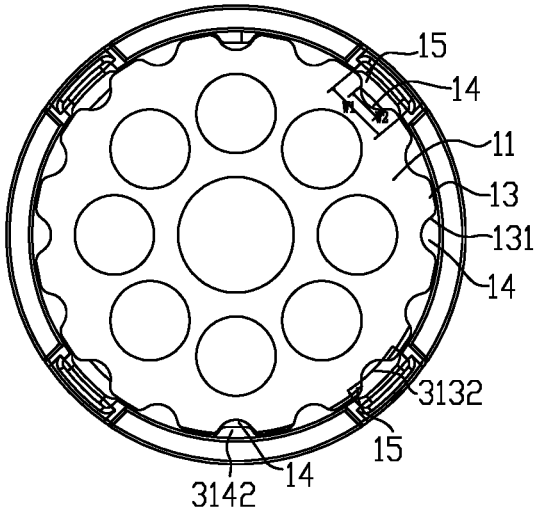
FIG. 6 is a bottom view of the ammunition loading and storage assembly shown in FIG. 1.

In the embodiment, the upper cover 30 includes a main body 31 in the shape of a bowl, a guide tube 32 extending from the main body 31 along a direction far away from the housing 10. A central axis of the guide tube 32 is offset from a central axis of main body 31 of the upper cover 30. In other words, the guide tube 32 is arranged on the edge area of main body 31 of the upper cover 30 for communicating with the elongated cavity 12. The main body 31 includes a bottom 311 and a side wall 312 extending from the bottom 311. The guide tube 32 has a through hole 33 which may be matched and communicated with any one of the elongated cavities 12 in the housing 10. A diameter of the through hole 33 allows one bullet to pass through. The number of the guide tube 32 is one in this embodiment. The upper cover 30 may be rotated on the housing 10, and when the through hole 33 is aligned in a straight line with any one of the elongated cavities 12, a straight channel 40 is formed by the guide tube 32 cooperatively with one of the plurality of elongated cavities 12. Then the elongated cavity 12 may be opened to load or download ammunition for gun. Furthermore, The side wall 312 has a ring body and a plurality of protruding buckles 314 extending from the ring body along a counterclockwise direction. The term "counterclockwise" here is not limited to counterclockwise, it may be "clockwise", and the extending direction substantially the same as the radian of the ring body. FIG. 5 illustrates two protruding buckles 314, but, the amount of the protruding buckle 314 is not limited to two, and may be adjusted according to actual requirements. The two protruding buckles 314 separated from each other and equidistant from each other on the upper cover 30. Each protruding buckle 314 includes an elastic beam 3141 extending from the ring body and a protrusion 3142 extending from the elastic beam 3141 towards the inner side of the upper cover 30. To improve the elasticity of the elastic beam 3141, it is understood that a gap 3143 is provided between the elastic beam 3141 and the ring body. During the rotation of the upper cover 30, when the protrusion 3142 and the groove 14 are matched with each other so that the protrusion 3142 is received in the groove 14 of the housing 10, the elongated cavities 12 may be covered by the upper cover 30. A dividing wall 121 between two adjacent long cavities faces the through hole 33 of the guide tube 32 so that each of the plurality elongated cavities 12 are covered by the bottom 311 of the upper cover 30 for blocking ammunition loading or downloading.

In additional, a plurality of jaws 313 extend from the ring body of the side wall 312 of the upper cover 30 along a direction far away the guide tube 32 for matching the clamping slot 15. Each of the plurality of jaws 313 has an arm 3131 and a hook 3132. A slot 3133 is provided on the both sides of each jaw 313 for improving the elasticity of the arm 3131, respectively.

Similarly, the lower cover 20 is bowl-shaped, and includes a bottom 21 and an annular side wall 22 extending from the bottom 21. An outer thread 16 is provided on the outer surface of the bottom end of the housing 10. An internal thread 23 is provided on the annular side wall 22 of the lower cover 20 for matching the outer thread 16 of the housing 10 for detachably fixing the bottom cover 20 on the housing 10. In addition to the threaded matching connection, there are other connection methods to block the bottom end of the housing 10.

While assembled, the upper cover 30 is installed on the top end of the housing 10, and the hook 3132 of the jaw 313 is at least partially received in the clamping slot 15 of the ridge 13 for preventing the upper cover 30 from falling off the housing 10. The plurality of hooks 3132 are received in the intermittent annular slot 151 formed by the plurality of clamping slots 15. The intermittent annular slot 151 serves as a guide groove, and the plurality of hooks 3132 act as a guider. Therefore, the upper cover 30 may be rotated on the housing 10. Furthermore, a width W1 of each hook 3132 is greater than the width W2 of each discrete groove 14. Even if the upper cover 30 is rotated to change the position of the hook 3132, the hook 3132 stays in the the clamping slot 15 does not slip out.

In additional, the protrusion 3142 of each protruding buckle 314 abuts against on the outer surface of the housing 10. During the upper cover 30 is rotated, each protruding buckle 314 slides on the ridge 13 and the discrete groove 14 alternately arranged one by one. Since elastic beam 3141 of the protruding buckle 314 is elastic, the protrusion 3142 moves from a lower position of the discrete groove 14 to a high position of the ridge 13 without breaking. Obviously, it is easy for the protrusion 3142 to move from the ridge 13 to the groove 14, and it is difficult to move from the groove 14 to the ridge 13.

During the upper cover 30 is rotated on the housing 10, the through hole 33 of the guide tube 32 rotates relative to each discrete elongated cavity 12 of the housing 10. When the protrusion 3142 of the protruding buckle 314 is received in one of the plurality of grooves 14, the through hole 33 of the guide tube 32 faces one of the plurality of elongated cavities 12 and overlap each other in a top view direction, then the straight channel 40 is formed by the guide tube 32 cooperatively with the one of the plurality of elongated cavities 12. In this way, ammunition may be loaded into the straight channel 40, or the ammunition in the straight channel 40 may be downloaded into the firearm. The upper cover 30 continues to be rotated, the protrusion 3142 of the protruding buckle 314 may be slide into an adjacent groove 14, and the through hole 33 is synchronously deviated from the one of the plurality of elongated cavities 12 so that each of the plurality of elongated cavities 12 is covered by the bottom of the upper cover 30. The upper cover 30 is further rotated again, the protrusion 3142 of the protruding buckle 314 may be slide into another groove 14 again, another straight channel 40 is formed by the through hole 33 of the guide tube 32 cooperatively with another of the plurality of elongated cavities 12.

Figure 7:
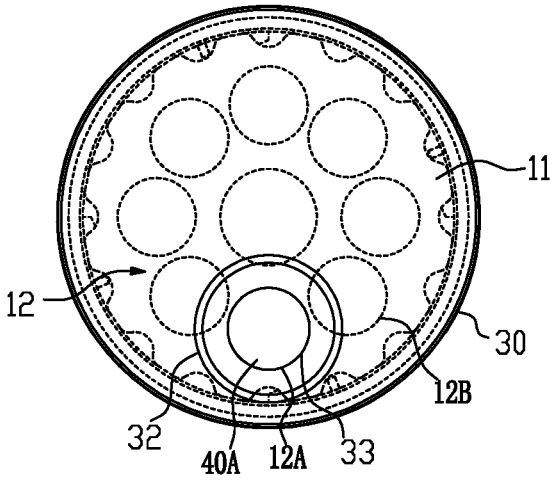
FIG. 7 is a top view of the ammunition loading and storage assembly shown in FIG. 1, with an elongated cavity being open.
Figure 8:
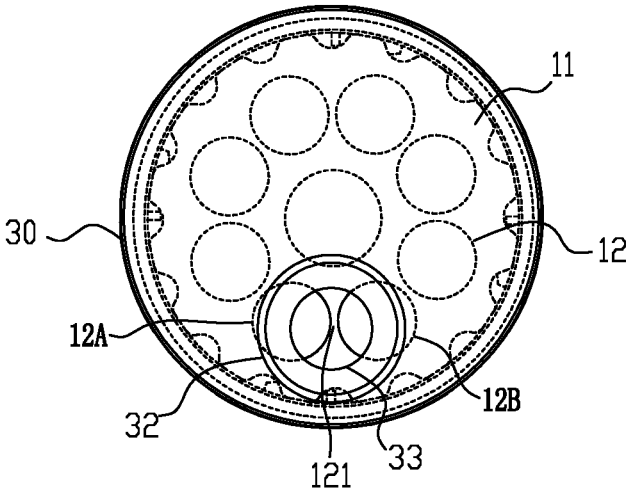
FIG. 8 is a top view of the ammunition loading and storage assembly shown in FIG. 7, with the elongated cavity being closed.
Figure 9:
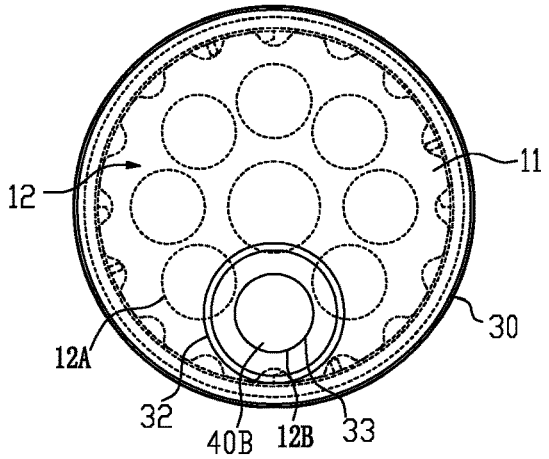
FIG. 9 is a top view of the ammunition loading and storage assembly shown in FIG. 7, from another aspect, with another elongated cavity being open.
Figure 10:
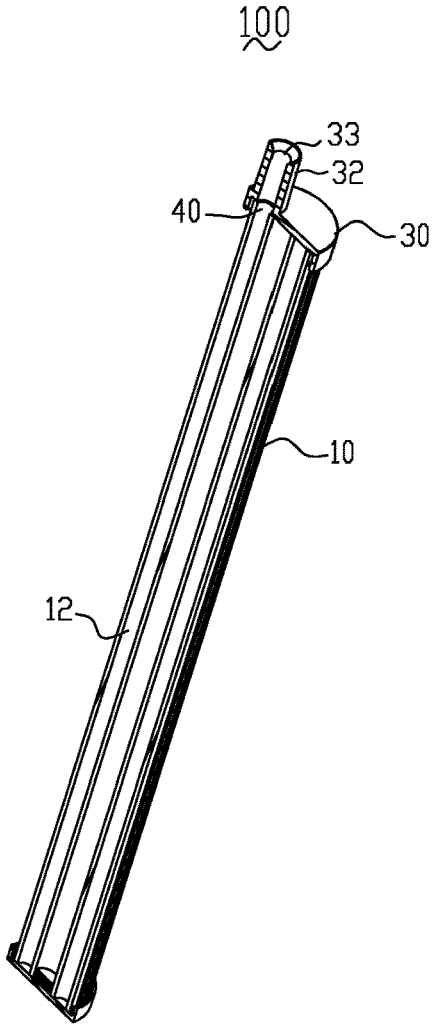
FIG. 10 is a cross-sectional view of the ammunition loading and storage assembly shown in FIG. 1, with a straight channel being formed.

Specifically, referring to FIGS. 7 to 9, one straight channel 40A is formed by the through hole 33 cooperatively with one elongated cavity 12A, on condition that the protruding buckle 314 is received in one of the plurality of discrete grooves 12. The upper cover 30 continues to be rotated, the protrusion 3142 of the protruding buckle 314 may be slide into another groove 14 adjacent to the one groove, then the straight channel 40A is gone. At this time, the through hole 33 of the guide tube 32 deviates from each of the plurality of elongated cavities 12, the the dividing walls 121 faces the through hole 33 of the guide tube 32 and each elongated cavities 12 is covered by the bottom 311 of the upper cover 30 for blocking ammunition loading or downloading. It is understood that ammunition in each elongated cavity 12 cannot be downloaded, and likewise external ammunition cannot be loaded into the elongated cavity 12. Then, removing the lower cover 20 from the housing 10, bullets may be loaded into each discrete elongated cavity 12 from the rear end of the housing 10 without being lost. Rotating the upper cover 30 again, the protruding buckle 314 is received in the next discrete grooves 14 so that another straight channel 40B is formed by the through hole 33 of the guide tube 32 cooperatively with one groove 12B of the plurality of elongated cavities 12, thereby forming a loop. That is to say, another straight channel 40B is formed by the guide tube cooperatively with another of the plurality of elongated cavities 12, on condition that the protruding buckle spans at least one discrete groove so as to accommodate in another groove of the plurality of discrete grooves 14. It is understandable that the term "span" here means the protrusion slides from a first groove into a second groove adjacent to the first groove without staying, and then slides into a third groove adjacent to the second groove. Consequently, rotating the upper cover 30 until at least one protruding buckle is received in one of the plurality of discrete grooves 14, so as to form a straight channel. Rotating the upper cover 30 again until the one protruding buckle is accommodated in another of the plurality of discrete grooves 14. At this time, all the plurality of elongated cavities 12 are closed, and the previous straight channel disappears. Turning the upper cover 30 a third time until the one protruding buckle is accommodated in another of the plurality of discrete grooves 14, and one of the plurality of elongated cavities 12 communicates with the through hole 33 of the upper cover 30 so as to form another straight channel. The one of the plurality of elongated cavities 12 is open for downloading bullet.

Figure 11:
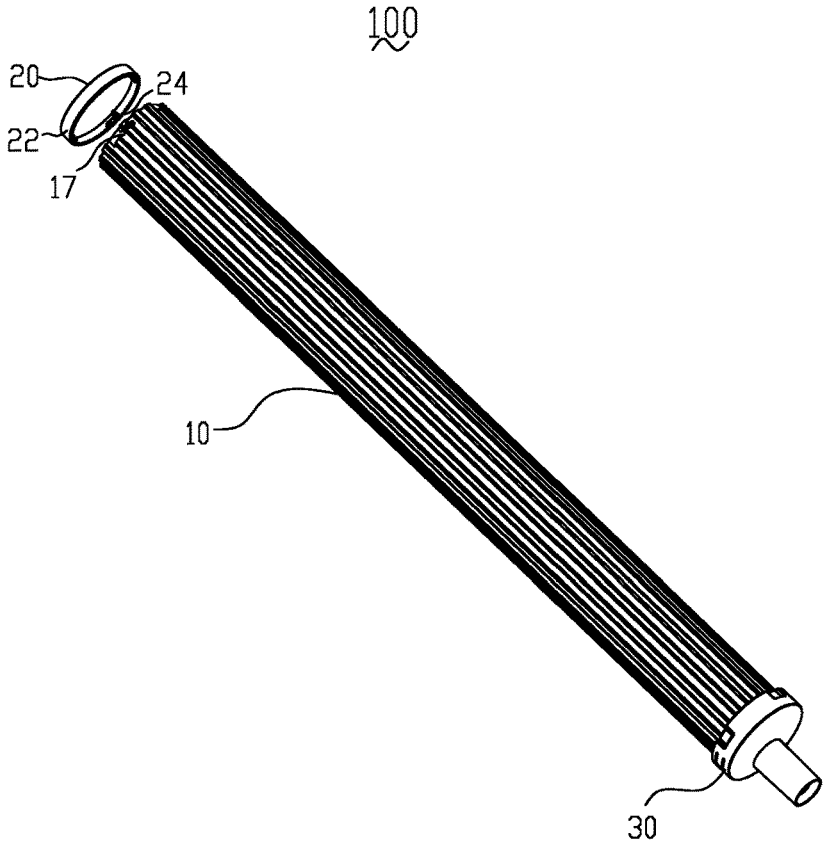
FIG. 11 is an isometric view of the ammunition loading and storage assembly in accordance with a second embodiment of the present disclosure.

Referring to FIG. 11. which shown a second embodiment of the present disclosure. The ammunition loading and storage assembly 100 includes a bottom cover 20 having a plurality of clamping strips 24 to replace the internal thread 23 on the bottom cover in the first embodiment. Correspondingly, the outer surface of the housing 10 may be provided with a plurality of notchs 17 for receiving plurality of clamping strips 24 so as to firmly connect the lower cover 20. The lower cover 20 may be an integral part of the housing 10. Other components shows in FIG. 10 but not mentioned have the same configurations and functions to the first embodiment. while the ammunition loading and storage assembly 100 is tilted upside down, the ammunition in the housing 10 may be conveniently poured from the guide tube 32 into the barrel of rifle, which is convenient for user.

Figure 12:
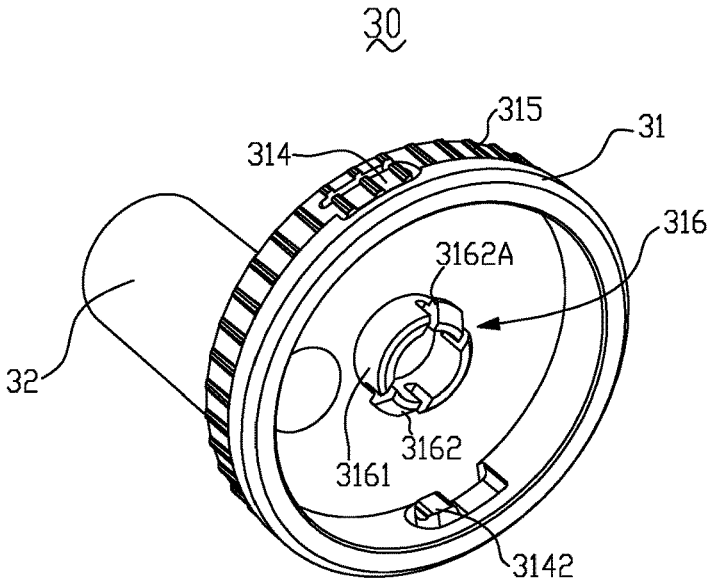
FIG. 12 is an isometric view of the ammunition loading and storage assembly in accordance with a third embodiment of the present disclosure, with a housing and a lower cover being removed.
Figure 13:
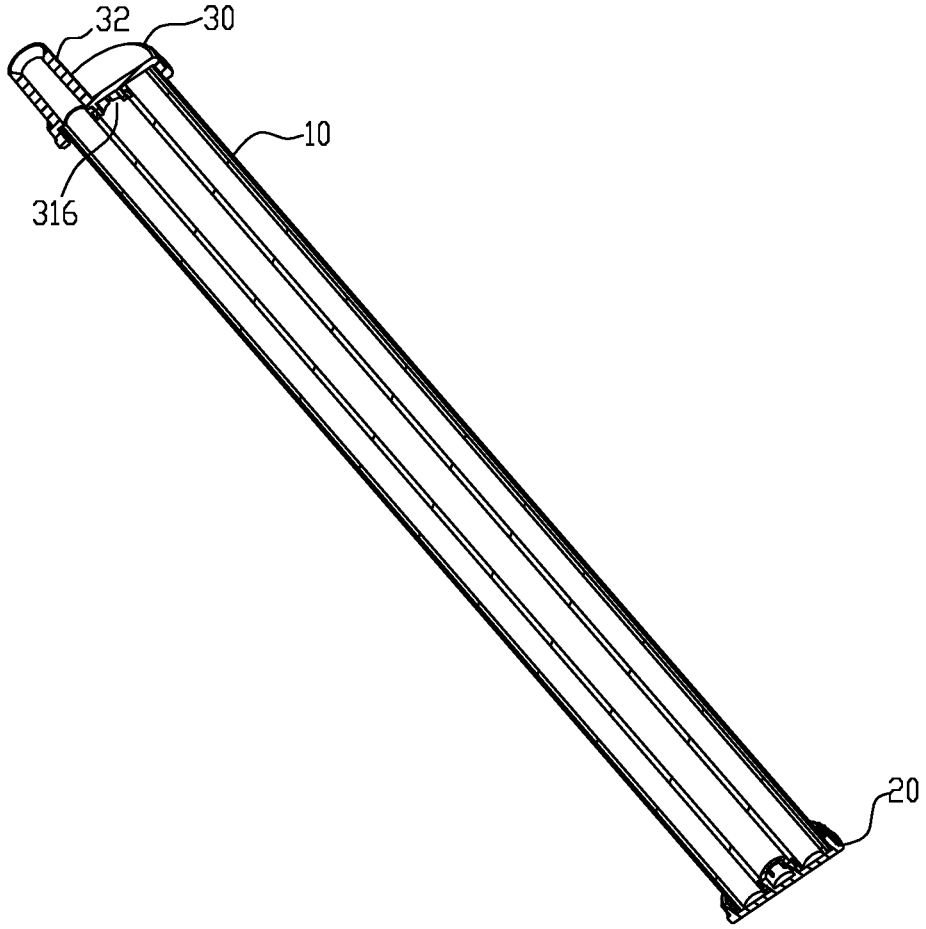
FIG. 13 is a cross-sectional view of the ammunition loading and storage assembly in accordance with a third embodiment of the present disclosure, with a straight channel being formed.

Referring to FIGS. 12 to 13. which shown a third embodiment of the ammunition loading and storage assembly 100 of the present disclosure, with the housing and the lower cover being removed. In the embodiment, the structure of the housing and the lower cover is equal to that of the housing 10 and lower cover 20 in the first embodiment. Somewhat differently, what is distinguished from the other embodiments is that a positioning unit 316 matching the positioning hole 16 is located in the central area of the upper cover. Specifically, the upper cover 10 includes a main body 31 in the shape of a bowl, a guide tube 32 with a through hole 33, a plurality of protruding buckles 314, a plurality of ribs 315 arranged on the main body 31 for enhancing friction, and the positioning unit 316 at least partially received in the the positioning hole 16 of the housing 10 for rotating coaxially with respect to the housing 10. The positioning unit 316 further includes a positioning wall 3161 and a positioning hook 3162 separated from the positioning wall 3161. A protrusion 3162A extends from the positioning hook 3162 for abutting against the positioning hole 16, and the positioning hole 16 has a step or a slot for matching the protrusion 3162A so that the upper cover 30 does not fall off from the housing 10. Compared with the related art, the configurations of the jaw 313 may be omit. However, the jaw 313 does not hinder the existence of the positioning unit 316, and them may be provided on the upper cover 30 together, or alternatively. Other components shown in FIG. 13 but not mentioned have the same configurations and functions to the first embodiment.

While the present disclosure has been described with reference to a specific embodiment, the description of the disclosure is illustrative and is not to be construed as limiting the disclosure. Various of modifications to the present disclosure can be made to the exemplary embodiment by those skilled in the art without departing from the true spirit and scope of the disclosure as defined by the appended claims.

What is claimed is:

1. An ammunition loading and storage assembly comprising:

a housing in the shape of a cylinder and an upper cover rotatably arranged at one end of the housing, the housing including a cylindrical body with a centre axis and a plurality of discrete elongated cavities distributed in the cylindrical body;

the housing further including a plurality of discrete grooves distributed on an outer surface of the housing around the centre axis of the cylindrical body;

the upper cover including a main body with a plurality of protruding buckles, a guide tube extending from the main body along a direction far away from the housing, the main body having a bottom and a side wall extending from the bottom;

a straight channel being formed by the guide tube cooperatively with one of the plurality of elongated cavities, on condition that the protruding buckle is received in one of the plurality of discrete grooves; wherein the side wall of the upper over includes a plurality of jaws extending in a direction far away from the guide tube for abutting against on the housing;

each of the plurality of jaws has an arm, a hook and a slot provided on the both sides of each law for improving the elasticity of the arm, respectively;

the guide tube deviates from each of the plurality of elongated cavities so that the elongated cavity is covered and blocked by the main body of the upper cover, on condition that the upper cover is rotated and the protruding buckle is accommodated in another groove adjacent to the one of the plurality of discrete grooves.

2. The ammunition loading and storage assembly as described in claim 1, wherein the guide tube is arranged on the edge area of main body of the upper cover for communicating with the elongated cavity of the housing.

3. The ammunition loading and storage assembly as described in claim 1, wherein the plurality of protruding buckles extend from the side wall for abutting against on the housing.

4. The ammunition loading and storage assembly as described in claim 3, wherein each protruding buckle includes an elastic beam extending from a ring body of the side wall, a protrusion extending from the elastic beam towards the inner side of the upper cover and a gap provided between the elastic beam and the ring body of the side wall.

5. The ammunition loading and storage assembly as described in claim 4, wherein a positioning hole surrounded by the plurality of discrete elongated cavities is arranged in a central area of the housing, and a positioning unit matching the positioning hole is provided in a central area of the upper cover.

6. The ammunition loading and storage assembly as described in claim 1, wherein two ridges are provided on both sides of each of the plurality of discrete grooves, respectively, a curved transition surface is provided between the ridge and the discrete groove for connecting to each other.

7. The ammunition loading and storage assembly as described in claim 6, wherein a clamping slot is provided on each of the plurality of ridges for receiving the hook of the jaw.

8. The ammunition loading and storage assembly as described in claim 7, wherein the clamping slots on each ridge together form an intermittent annular groove which is cooperated with the plurality of jaws.

9. The ammunition loading and storage assembly as described in claim 8, wherein a width of the hook of the jaw is greater than that of each plurality of discrete grooves.

10. An ammunition loading and storage assembly comprising:

a housing in the shape of a cylinder and an upper cover arranged at one end of the housing, the housing including a cylindrical body with a centre axis and a plurality of discrete elongated cavities distributed in the cylindrical body; and wherein the housing further includes a plurality of discrete grooves and a plurality of ridges distributed on an outer surface of the housing around the centre axis of the cylindrical body, and each discrete groove provided between two adjacent ridges;

the upper cover includes a main body with a plurality of protruding buckles, a guide tube extending from the edge area of main body along a direction far away from the housing;

a straight channel is formed by the guide tube cooperatively with one of the plurality of elongated cavities, on condition that the protruding buckle is received in one of the plurality of discrete grooves; wherein the main body of the upper cover includes a bottom, a side wall extending from the bottom and the plurality of protruding buckles extending from the side wall for abutting against on the housing;

each protruding buckle includes an elastic beam extending from a ring body of the side wall, a protrusion extending from the elastic beam towards the inner side of the upper cover and a gap provided between the elastic beam and the ring body of the side wall;

another straight channel is formed by the guide tube cooperatively with another of the plurality of elongated cavities, on condition that the upper cover is rotated, and the protruding buckle spans at least one discrete groove so as to accommodate in another groove of the plurality of discrete grooves.

11. The ammunition loading and storage assembly as described in claim 10, wherein the upper cover further includes a plurality of jaws extending along a direction far away from the guide tube for abutting against on the housing so as not to fall off from the housing.

12. The ammunition loading and storage assembly as described in claim 11, wherein each of the plurality of jaws has an arm, a hook and a slot provided on the both sides of each jaw for improving the elasticity of the arm, respectively.

13. The ammunition loading and storage assembly as described in claim 12, wherein a clamping slot is provided on each of the plurality of ridges for receiving the hook of the jaw.

14. The ammunition loading and storage assembly as described in claim 13, wherein the clamping slots on each ridge together form an intermittent annular groove which is cooperated with the plurality of jaws.

15. The ammunition loading and storage assembly as described in claim 10, wherein a positioning hole surrounded by the plurality of discrete elongated cavities is arranged in a central area of the housing, and a positioning unit matching the positioning hole is provided in a central area of the upper cover.

16. The ammunition loading and storage assembly as described in claim 12, wherein a width of the hook of the jaw is greater than that of each of the plurality of discrete grooves.

* * * * *